United States Patent [19]

Aldous et al.

[11] Patent Number: 4,467,726

[45] Date of Patent: Aug. 28, 1984

[54] STABILIZING APPARATUS

[75] Inventors: Derek R. Aldous, Wembley; Robert J. Melling, Watford, both of England

[73] Assignee: British Telecommunications, London, England

[21] Appl. No.: 315,545

[22] Filed: Oct. 27, 1981

[30] Foreign Application Priority Data

Oct. 28, 1980 [GB] United Kingdom ..... 8034668

[51] Int. Cl.[3] ..... B61F 9/00

[52] U.S. Cl. ..... 104/246; 104/242; 343/882

[58] Field of Search ..... 104/246, 242, 245, 248; 343/781 CA, 882

[56] References Cited

U.S. PATENT DOCUMENTS 1,250,797 12/1917 Cheneau ..... 104/246
1,612,271 12/1926 Edson ..... 104/246
1,764,941 6/1930 Edson ..... 104/246
3,292,559 12/1966 Cousins et al. ..... 104/246
3,357,022 12/1967 Giger ..... 343/781 CA X
3,729,890 5/1973 Yamamoto et al. ..... 104/246 X

FOREIGN PATENT DOCUMENTS 701923 3/1931 France ..... 104/246

*Primary Examiner*—Randolph Reese
*Attorney, Agent, or Firm*—Cushman, Darby & Cushman

[57] ABSTRACT

A stabilizing device for a satellite tracking communications aerial comprises a first element which depends from the frame of the aerial and a second element which carries at its lower end one or more rollers arranged to run along the downwardly facing surface of a rail. The first element carries a plate and the second element carries plates. A spring extends between the plates so that the rollers are biased into contact with the surface and any tendency of the aerial to rise is resisted by the action of the spring on the plate.

12 Claims, 3 Drawing Figures

STABILIZING APPARATUS

DESCRIPTION

This invention relates to a stabilizing device for stabilizing movement of a body which has one or more wheels arranged to run on a rail or rails. The invention has particular application to the stabilization of satellite tracking communication aerials.

Satellite tracking communication aerials comprise a generally parabolic dish which is arranged to receive electromagnetic waves. The dish is mounted upon a framework which usually has a rectangular or square base. The corners of the base are mounted upon wheels which are arranged to run on a circular railway type track. This allows the aerial to be rotated so that it can be moved in azimuth to track a satellite.

A problem with such an aerial is that of maintaining contact between the wheels and the rail. In high winds the aerial tends to act as a sail and the wheels can lift from the rail thereby causing loss of friction between the wheel and the rail. The result is that the wheels can be neither driven nor braked. Also when the wind subsides the structure tends to drop suddenly onto the rails and can damage the foundations on which the rail is mounted and the frame structure of the aerial.

One known arrangement for overcoming this problem is to provide a stabilizing device which takes the form of an arm or rod which depends from the base of the frame structure from a point close to each wheel, the rod at its lower end being bifurcated to define two limbs of a jaw which are so shaped as to closely engage around the flanged upper part of the rail. Upward movement of the aerial is restricted by each limb coming into contact with a downwardly facing surface of the rail. However such an arrangement operates only to restrict the amount of lift which can occur to about 1 m.m. since there has to be a certain degree of tolerance between the rail and each limb in order to allow movement of the aerial structure around the rail. Thus while the degree of lift can be restricted to an amount which causes little or no damage when the structure drops back onto the rail it still does not maintain contact between the wheel and the rail in strong winds and thus drive and braking are still ineffective in such conditions.

The present invention is concerned with a stabilizing arrangement which attempts to alleviate this problem.

According to the present invention there is provided stabilizing means for a body which has one or more wheels arranged to run on a rail comprising a first substantially rigid element which is arranged to depend from the body and which has a first reaction surface, a second substantially rigid element which has means arranged to engage a downwardly facing surface of the rail and defines a second reaction surface, said first and second elements being movable axially relative to each other, and bias means acting on said first and second reaction surfaces so that, in use, said engaging means is maintained in contact with said rail surface and any tendency of the body to rise is resisted by the action of said bias means on said first reaction surface.

In this arrangement the action of the biasing means is to maintain the engaging means permanently in contact with the downwardly facing surface on the rail. Also by virtue of its action on the first reaction surface the biasing means produces a downwardly directed force which acts to prevent uplift of the body. Thus in the case of a satellite tracking communication aerial, uplift due to high winds will not occur provided that the upwardly directed force due to the wind is not greater than that exerted downwardly by the biasing means plus the dead weight of the aerial. The load exerted by the biasing means can thus be selected to accommodate expected wind strengths.

The engaging means may comprise one or more rollers arranged to run against the downwardly facing surface of the rail. The lower part of the second element may have a plurality of roller mountings, the mountings being arranged in pairs extending downwardly one on each side of the rail, each mounting including an axle on which is mounted said roller which engages the downwardly facing surface on the rail.

The first element may comprise a beam which extends downwardly from the body and carries towards its lower end a first plate the upper surface of which constitutes said first reaction surface. The second element may include a plurality of rods each of which carries towards its upper end a second plate the lower surface of which constitutes said second reaction surface, each of said rods of the second element extending through a respective aperture in the first plate to permit said axial movement. Each rod at its lower end may carry a mounting for a roller which is arranged to run against the downwardly facing surface of said rail.

Said biasing means may comprise a spring which is arranged in compression between said first and second plates.

In the case of a satellite tracking communication aerial one or more stabilizing devices can be associated with each wheel on which the aerial is mounted.

The invention will be described now by way of example only with particular reference to the accompanying drawings. In the drawings.

Figure 1:
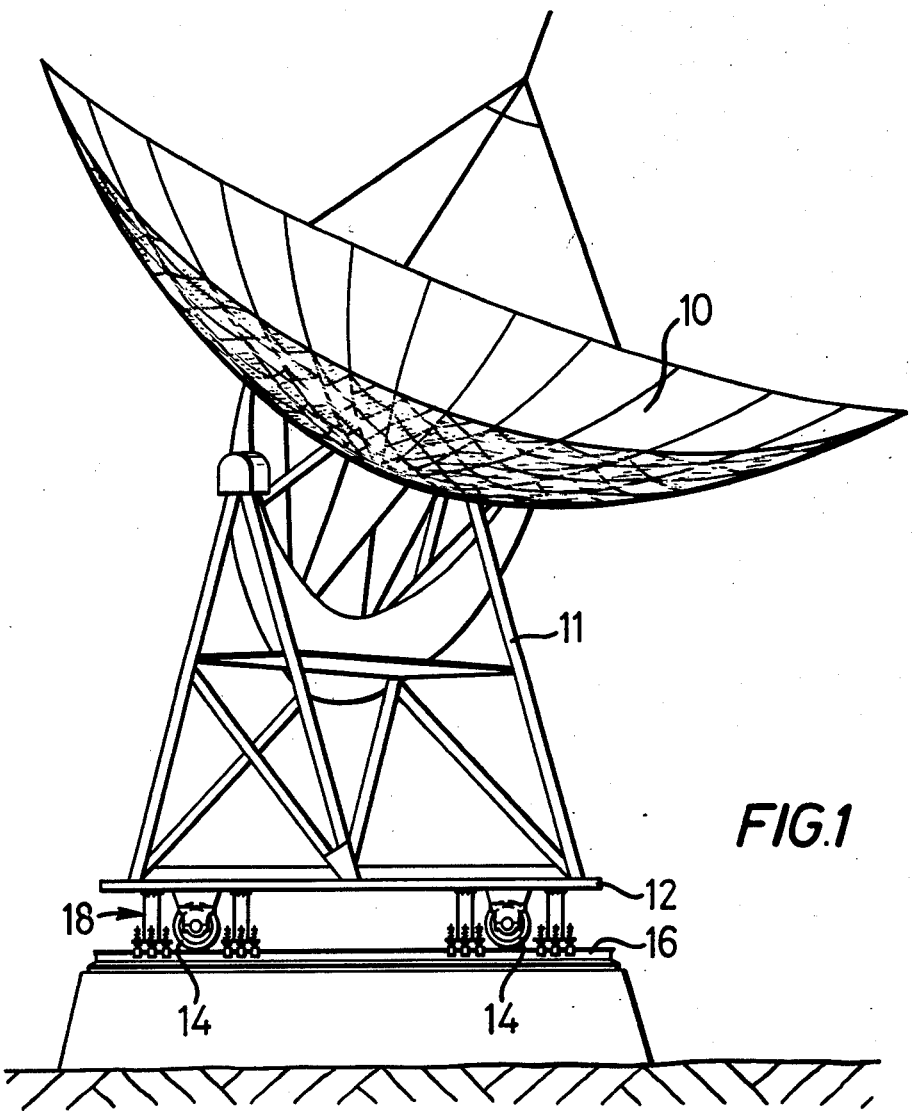
FIG. 1 is a view of a satellite tracking communication aerial.

Referring to FIG. 1 a communication aerial comprises a parabolic dish 10 which is mounted upon a frame structure 11. The base 12 of the frame structure 11 is generally rectangular and is mounted at each corner thereof on wheels 14. The wheels run upon a circular rail shown at 16 so that the aerial can be rotated through 360° about a generally vertical axis. On either side of each wheel 14 there is provided a stabilization device 18. The stabilization devices are shown in more detail in FIGS. 2 and 3 to which reference will now be made.

Each stabilization device 18 comprises a first generally rigid element in the form of an I-section beam 19 which extends downwardly from the lower part of the frame structure 11. Each I-beam 19 has a web portion 20 and flanges 21, 22 formed integrally therewith. At its upper end, the I-beam 19 has an integral plate 24 by means of which it is bolted to the lower part of the frame structure 11. At its lower end, the I-beam 19 carries a rectangular plate 26 which is formed integrally with the beam. The plate 26 has six through apertures formed therein, the apertures being arranged in two lines of three apertures each disposed one on each side of a plane containing the web 20. Each aperture receives an upwardly extending sleeve 28. Toward its lower end the wall thickness of each sleeve is reduced to define a shoulder 29 which sits on the plate 26. Each sleeve is secured relative to the plate 26 by means of a nut 30 threaded on the exterior of the sleeve 28.

Figure 2:
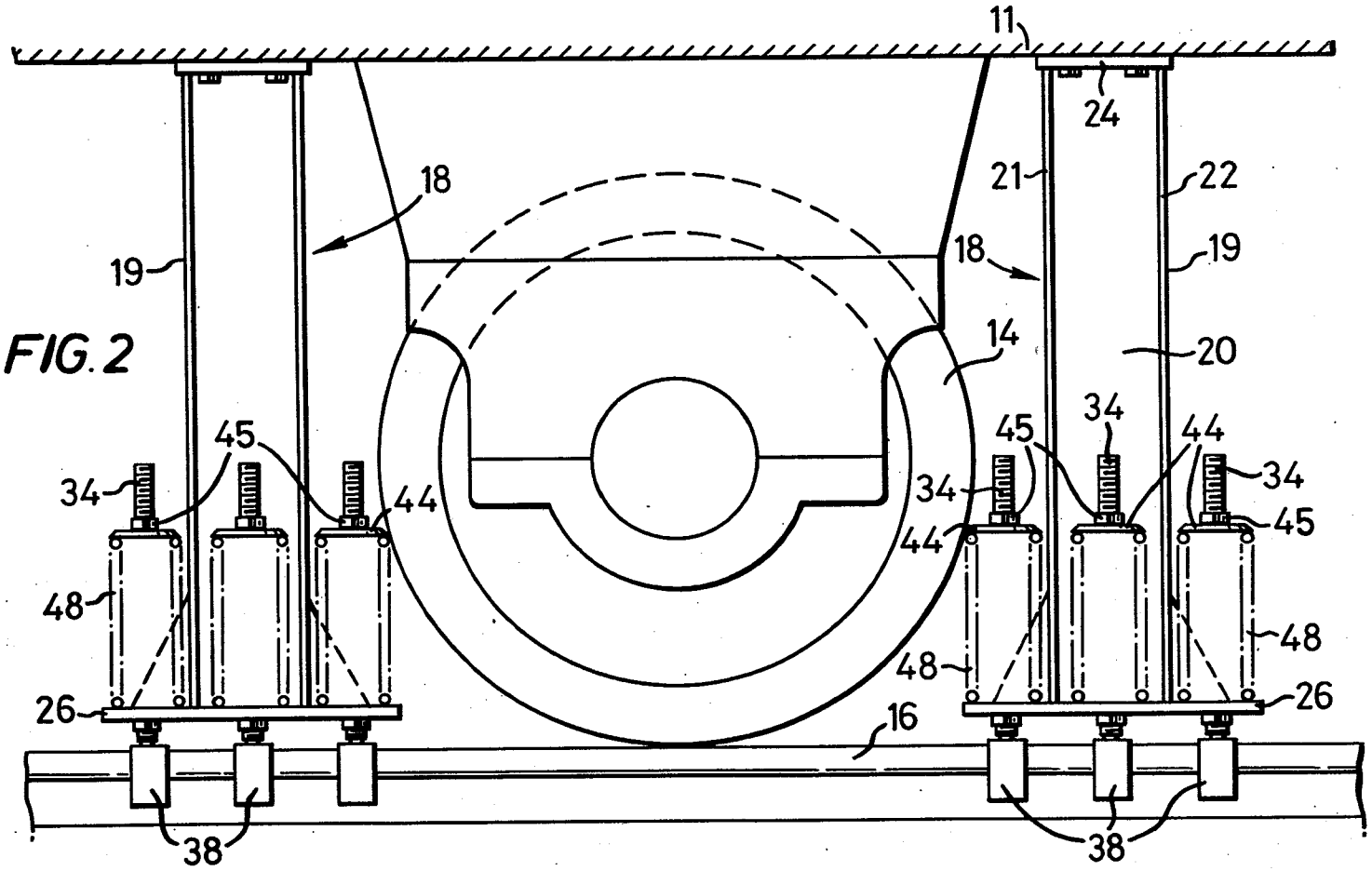
FIG. 2 is a side elevation illustrating two stabilization devices in accordance with the present invention mounted on such an aerial.
Figure 3:
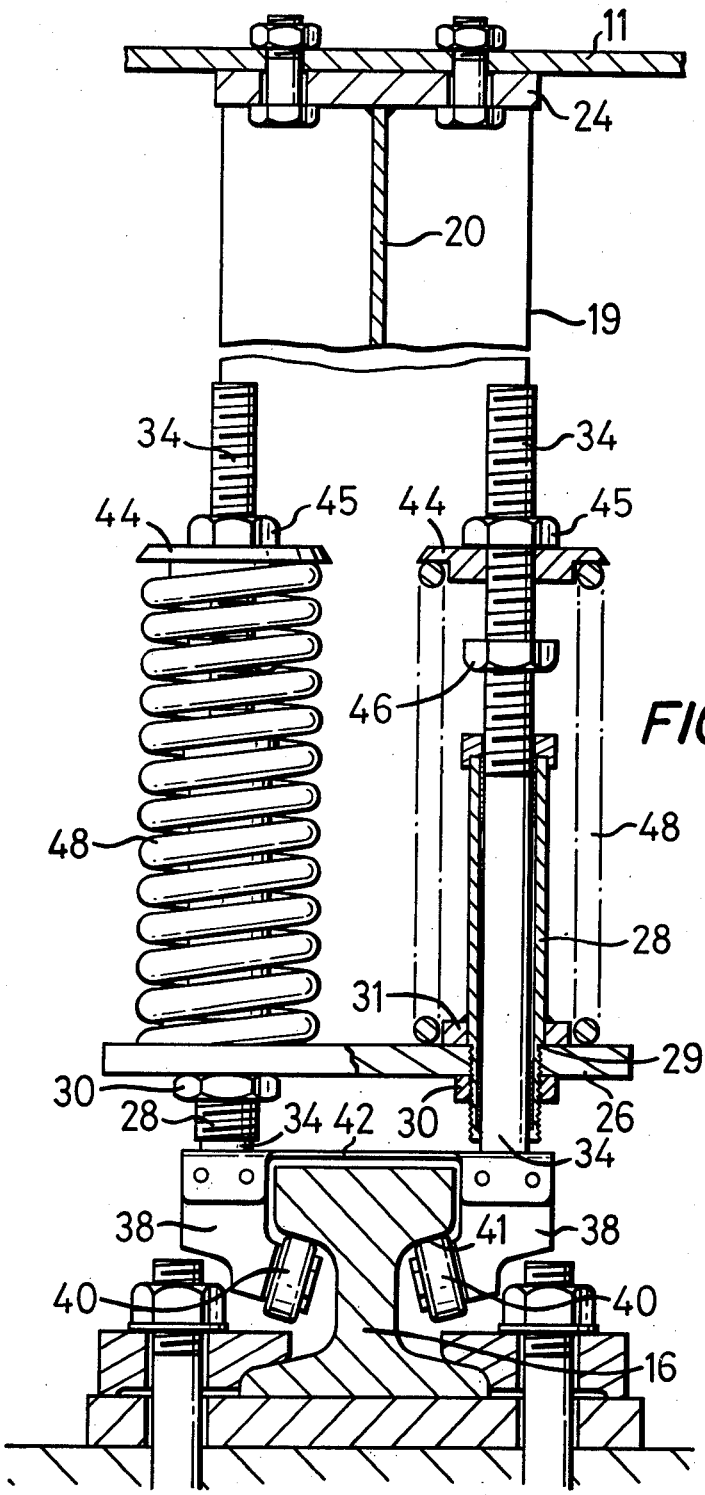
FIG. 3 is an elevation partly in section of a stabilization device in accordance with the present invention.

The stabilizing device has a second generally rigid element which includes six upwardly extending rods 34 (three shown in FIG. 2 and two shown in FIG. 3). Each rod extends through a respective one of the sleeves 28 and is arranged so that it can move axially relative to the sleeve. Each sleeve contains two PTFE bushes in which the respective rod can slide. Each rod 34 carries at its lower end a mounting 38 for a roller 40. Each roller is rotatably mounted on an axle on the mounting 38 and arranged so that the surface of the roller 40 can run along the downwardly facing surface 41 of the flanged upper part of the rail 16 (see FIG. 3). The mountings 38 are arranged so that three extend downwardly adjacent one side of the rail 16, and the other three extend downwardly adjacent the opposite side of the rail. Pairs of opposite mountings 38 are linked by means of a steel strip 42 extending transversely over the upper surface of the rail 16. Each rod 34 carries towards its upper end a circular plate 44. A spring 48 is mounted between each plate 44 and the plate 26. The upper end of the spring engages a spring seat on the lower side of the plate 44 and the lower end is located around a spacer washer 31. Each spring is arranged in compression so that it exerts an upward force on each plate 44 and a downward force on the plate 26. Upward movement of each plate 44 is resisted by a nut 45 which is threaded onto each rod 34. A further nut 46 is threaded on the rod 34 below the plate 44 and acts as a stop to limit axial movement of the rod relative to the sleeve 28.

It will be seen that the springs 48 act to maintain the rollers 40 in permanent contact with the downwardly facing surface 41 of the rail and also exert, by way of the beam 19 a downwardly directed force on the frame structure 11 of the aerial. Thus, it will be seen that any tendency of the frame structure 11 to lift in the presence of a wind will be resisted by the action of the springs 48. The force exerted by the spring in the downward direction can be selected to apply a predetermined load to the frame structure by adjustment of the nuts 45. The stabilizing device also allows any irregularities in the rail profile to be accommodated since each rod 34 can move axially within its sleeve 28 relative to the I-beam 19 and the spring 48 ensures that contact between each roller 40 and the rail 16 is maintained.

The stiffness of each spring is selected so that the loading on each roller 40 does not change significantly with small variations in spring length, and so that the spring can be compressed during installation on site without special tools. The steel strip 42 is provided for the following reason. Because the thrust of each spring 48 cannot be in line with the point of contact between the associated roller and the rail, the associated rod 34 is subjected to bending stresses. To keep these stresses within allowable limits the mountings 38 are connected by the strip 42. The strip also maintains the axis of rotation of the rollers perpendicular to the rail axis. The flexibility of the strip allows the rollers of each pair to move vertically independently of each other as the rollers follow the profile of the rail.

The device can be used in association with a conventional jaw type device. The jaws, which are provided to restrict wheel up lift in the event that winds are strong enough to overcome the downward forces, can be located between pairs of rollers under the plate 26.

It will be appreciated that, as shown in FIG. 2, a stabilizing device is provided on either side of each of the four wheels on which the aerial runs. The two stabilizing devices associated with a particular wheel should be linked to the wheel mounting to ensure that the rollers move along the rail 16 with the movement of the wheel 14. As shown in the drawings three pairs of rollers are associated with each stabilizing device. It will be appreciated that any number of rollers could be used, the preferred arrangement being with the rollers arranged in pairs.

The stabilizing device described above has the feature that it can be fitted relatively easily to existing aerial structures without the requirement for modification of the aerial. It is not necessary to take the aerial out of service in order to fit the device since the device can be fitted on site. The stabilizing device can be used on structures other than aerials which are arranged to run on rails.

We claim:

1. A stabilized moveable antenna mount for a tracking communications antenna, said mount comprising:

a circular support rail having both upwardly and downwardly facing bearing surfaces;

a mounting platform including a support frame bearing a plurality of rotatable support wheels in rolling engagement with said upwardly facing bearing surface of said support rail; and stabilizing means depending from said support frame and including at least one pair of rollers spring biased into constant positive resilient rolling driving engagement with opposite edge surfaces of said downwardly facing bearing surface of said support rail so as to maintain constant rolling engagement between said upwardly facing bearing surface of the rail and said support wheels, one said stabilizing means being disposed along said rail in front of at least one of said support wheels and another said stabilizing means being disposed along said rail behind said at least one of said support wheels.

2. A stabilized moveable antenna mount as in claim 1 wherein the rollers of each said pair of rollers are interconnected across the top of said rail by a resilient metal strip.

3. A stabilized moveable antenna mount as in claim 2 wherein each said stabilizing means includes plural successive pairs of rollers spring biased into constant resilient rolling engagement with opposite edge surfaces of said downwardly facing bearing surface of said support rail.

4. A mounting arrangement for a tracking communications antenna comprising:

a support rail having upwardly and downwardly facing bearing surfaces, a mounting platform comprising a frame to support said antenna, and a plurality of wheels arranged to run on said upwardly facing bearing surface, said mounting platform further comprising stabilizing means including a first substantially rigid element which depends from the platform and which has a first reaction surface, a second substantially rigid element which has means arranged to engage said downwardly facing bearing surface and defines a second reaction surface, said first and second elements being moveable axially relative to each other, and biasing means acting on said first and second reaction surfaces so that, in use, said engaging means is maintained in contact with said rail surface and any tendency of the wheels to rise is resisted by the action of said biasing means on said first reaction surface.

5. A mounting arrangement as claimed in claim 4 wherein the engaging means comprise one or more rollers arranged to run against the downwardly facing bearing surface of the rail.

6. A mounting arrangement as claimed in claim 5 wherein the lower part of the second element has a plurality of roller mountings, the mountings being arranged in pairs extending downwardly, one on each side of the rail, each mounting including an axle on which is mounted a said roller which engages the downwardly facing surface on the rail.

7. A mounting arrangement for a satellite tracking communication antenna comprising:

a support rail having upwardly and downwardly facing bearing surfaces, a mounting platform comprising a frame to support said antenna, and a plurality of wheels arranged to run on said upwardly facing bearing surface, said mounting platform further comprising stabilizing means associated with each of said wheels, said stabilizing means including a first substantially rigid element which is arranged to depend from the platform and which has a first reaction surface, a second substantially rigid element which has means arranged to engage said downwardly facing bearing surface and defines a second reaction surface, said first and second elements being movable axially relative to each other, and bias means acting on said first and second reaction surfaces so that, in use, said engaging means is maintained in contact with said rail surface and any tendency of the wheels to rise is resisted by the action of said bias means on said first reaction surface.

8. A mounting arrangement as claimed in claim 7 wherein said bias means comprises a spring which is arranged in compression between said first and second reaction surfaces.

9. A mounting arrangement as claimed in claim 4, 7, 8, 5 or 6 wherein the first element comprises a beam which extends downwardly from the mounting platform and carries towards its lower end a first plate the upper surface of which constitutes said first reaction surface.

10. A mounting arrangement as claimed in claim 9 wherein the second element includes a plurality of rods each of which carries towards its upper end a second plate the lower surface of which constitutes said second reaction surface, each of said rods of the second element extending through a respective aperture in the first plate to permit said axial movement.

11. A mounting arrangement as claimed in claim 10 wherein said biasing means comprises a spring which is arranged in compression between said first and second plates.

12. A mounting arrangement as claimed in claim 9 wherein each rod at its lower end carries a mounting for a roller which is arranged to run against the downwardly facing bearing surface of said rail.

* * * * *